United States Patent [19]

Brammer

[11] 3,972,170

[45] Aug. 3, 1976

[54] REINFORCING MEMBER FOR SPACED FLANGES OF A FRAME MEMBER

[76] Inventor: Robert C. Brammer, 336 W. 7th St., Traverse City, Mich. 49684

[22] Filed: May 23, 1974

[21] Appl. No.: 472,857

[52] U.S. Cl. ..... 52/750; 52/DIG. 11; 52/729; 248/499

[51] Int. Cl.[2] ..... E04H 9/14

[58] Field of Search ..... 248/361 R, 361 A, 354 S, 248/354 L, 354 R, 119, 228, 499; 52/729, 722, 4, 23, 149, 156, 157, 750; 280/150.5

[56] References Cited

UNITED STATES PATENTS

| | | | |
|---|---|---|---|
| 3,125,177 | 3/1964 | Paller | 248/361 X |
| 3,143,325 | 8/1964 | Carpenter et al. | 248/361 X |
| 3,724,151 | 4/1973 | Kaywood et al. | 52/295 |
| 3,744,192 | 7/1973 | Burnett | 52/23 |
| 3,798,867 | 3/1974 | Starling | 52/729 X |
| 3,830,024 | 8/1974 | Warnke | 52/23 |

*Primary Examiner*—Roy D. Frazier
*Assistant Examiner*—Terrell P. Lewis
*Attorney, Agent, or Firm*—Price, Heneveld, Huizenga & Cooper

[57] ABSTRACT

A reinforcing member for reinforcing the spaced flanges of a frame member utilizes a rigid member adapted to nest between the flanges which includes at least two strap-receiving openings adapted to have a tie-down strap passed around the frame member and into and around the reinforcing member. The reinforcing member prevents collapsing of the frame member when the tie-down strap is tightened.

7 Claims, 5 Drawing Figures

REINFORCING MEMBER FOR SPACED FLANGES OF A FRAME MEMBER

BACKGROUND OF THE INVENTION

This invention relates to devices for reinforcing spaced flanges of a frame member and more particularly to devices used to prevent collapsing of the flanges when a strap or the like is wrapped therearound.

Mobile homes or the like which are parked in a position for any duration of time are usually secured with tie-down straps or cables to prevent them from being blown over or pushed along by wind. Such tie-down straps or cables usually extend over the top of the mobile home in one or more locations along its length and are secured to the ground adjacent the sides of the trailer. Building and/or zone ordinances, additionally, typically require frame tie-down straps at specified intervals along the length of the structure.

Typically, mobile homes or the like utilize flanged frame members. These frame members are generally "I" beam structures. To anchor a mobile home in position along the ground, it is customary to extend straps or cables around these I beams, attach the strap or cable to an anchoring device inserted in the ground, and secure the trailer to the anchoring device by placing the strap or cable under tension.

A problem which is common to such systems is that as the strap or cable is placed under tension, the flanged portion of the I beam is deformed. It is readily apparent that this problem could be solved by utilizing very heavy or extensively reinforced I beam members. Such a solution is not feasible, however, from an economic standpoint. Further, it is not feasible to reinforce the trailer frame only at certain select places on the frame since it is not usually possible to predetermine where the tie-down strap or cable will be attached to the trailer.

OBJECTS AND SUMMARY OF THE INVENTION

Accordingly, it is an object of the present invention to provide a reinforcing member for reinforcing the spaced flanges of a frame member so that the same can be secured to an anchor without collapsing the flanges toward each other.

It is a further object of the present invention to provide a reinforcing member which will prevent the collapsing or deformation of flanged frame members of a mobile home when it is tied down thereby.

It is still a further object of the present invention to provide a reinforcing member which utilizes a minimum of materials and which is placed along a frame or other flanged member only at desired positions where it will be used.

These and other objects of the present invention are accomplished by a reinforcing member particularly adapted to reinforce the spaced flanges of a frame member so that the same can be secured to an anchor without collapsing the flanges toward one another. The reinforcing member is rigid and has a length approximating the distance between the flanges and is adapted to nest between the flanges, with the ends of the member abutting the flanges.

The reinforcing member includes at least two strap-receiving openings along its length with the openings being adapted to have a tie-down strap encircling the exterior of the frame member passed thereinto and thereoutof such that the strap is on the exterior of the reinforcing member between each of the openings and the adjacent ends of the member and behind the member for at least a portion of the distance between the openings.

The reinforcing member is particularly useful to reinforce a frame member of a mobile home or the like.

DESCRIPTION OF THE PREFERRED EMBODIMENT

Figure 1:
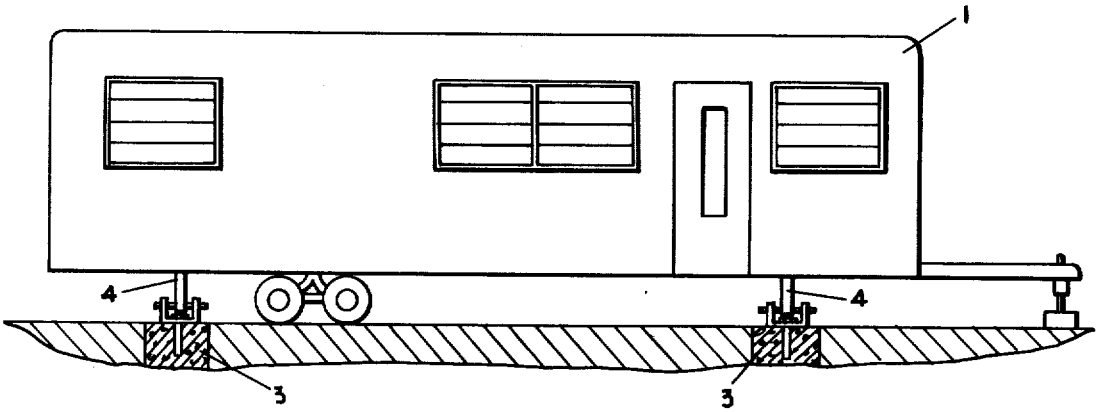
FIG. 1 is an elevational side view of a typical mobile home secured with tie-down straps attached to the mobile home along the base thereof and to anchors in the ground.
Figure 2:
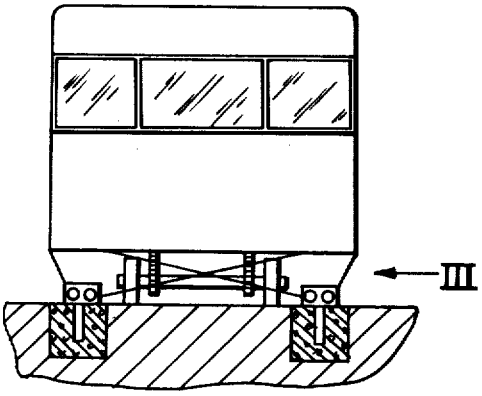
FIG. 2 is a rear end elevational view of the mobile home of FIG. 1.

Referring to the drawings, a mobile home 1 as shown in FIGS. 1 and 2, is anchored from its frame 2 (FIG. 3) to a tie-down anchor 3 by strap 4. Additional anchoring is obtained via strap 4*a* which passes over the home and is also affixed to anchor 3. Anchors 3, preferably, are fabricated in accordance with the teachings of application Ser. No. 429,814, filed January 2, 1974, now U.S. Pat. No. 3,884,450.

Figure 4:
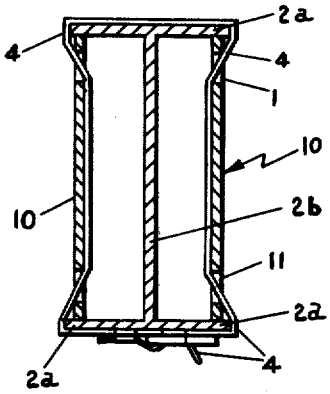
FIG. 4 is a cross section view taken along plane IV—IV of FIG. 3.
Figure 3:
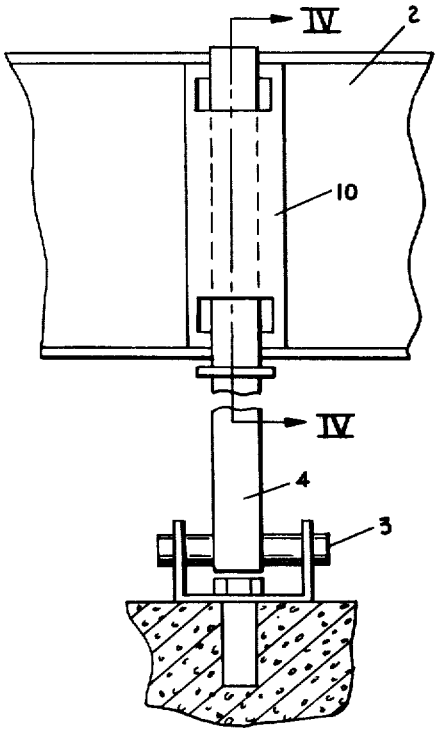
FIG. 3 is an enlarged partial side elevational view of the mobile home frame with the reinforcing member which is the subject of this invention in working position.

As shown in FIGS. 3 and 4, tie-down strap 4 is threaded around beam 2 and through reinforcing members 10 which are inserted between flanges 2*a* of frame or I beam 2.

Mobile home 1 is representative of any one of a number of conventionally available mobile homes, trailers, etc. The frame 2 of mobile home 1 is similarly representative of a number of flanged frame members for mobile homes or trailers. These frame members are integrally formed as a part of the mobile home, etc. so that securing of the base in a fixed position acts to secure the mobile home in fixed position.

Tie-down strap 4 is representative of any one of a number of conventional straps, cables, cords, etc. which are used to anchor mobile homes. As shown, it is a strap made of a suitable metal.

Figure 5:
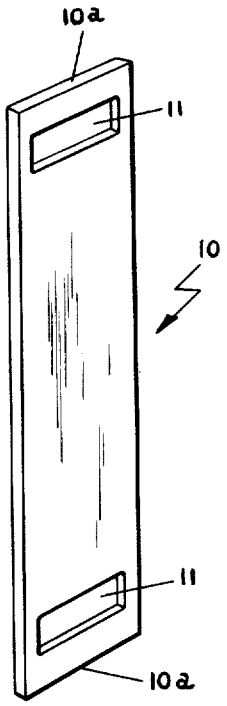
FIG. 5 is a perspective view of the reinforcing member.

As is readily apparent from these figures and in particular, FIG. 5, reinforcing member 10 is elongated and rectangular in shape and generally planar. Near both of the end portions thereof, rectangular apertures 11 extend through reinforcing member 10. It is formed, preferably, from steel and is of sufficient thickness to bear the compressive load exerted by the tensioned strap. A thickness of approximately one-eighth inch has been found sufficient in the typical operating environment.

When securing member 10 to beam 2 (FIGS. 3–4), tie-down strap 4 is wrapped around the flanges 2*a* of I beam 2 and threaded through apertures 11 so that the greater part of strap 4 extending between flanges 2*a* is internal to the closure, formed by flanges 2*a* and I portion 2*b* of beam 2 and reinforcing member 10 so that when strap 4 is placed under tension, member 10 is secured in close abutting position between the exterior edges of flanges 2*a*.

Strap 4 may be looped through member 10 and around beam 2 and through buckle 5 as shown in FIG. 4, or alternatively, it may be looped around the end portion 10*a* and aperture 11 so as to be secured from slipping when tension is placed on strap 4 and strap 4 tightens against itself.

Respective and opposite ends of member 10 act to engage the internal surfaces of flanges 2*a* by abutting therebetween. As is apparent from FIGS. 3 and 4, ends of reinforcing member 10 engage flanges 2*a* so that as strap 4 is tightened around beam 2 and straps 4 pull downward thereon, flanges 2*a* will be slightly deformed into end portions of member 10 and member 10 will prevent further deformation of beam 2.

As strap 4 is tightened, when it is threaded through reinforcing member 10 so that most of strap 4 is internal to the closure formed by member 10 and beam 2 as above discussed, member 10 will be biased inward between flange 2*a* rather than outward from the flanges 2*a*.

OPERATION

When anchoring mobile home 1 to tie-down anchor 3, strap 4 at one end thereof is threaded through reinforcing members 10 as shown in FIG. 4 and as above discussed, and at the other end thereof to tie-down anchor 3 which is preferably on the opposite side of the trailer. As tie-down strap 4 is tightened, flanges 2*a* of beam 2 are deflected into end portion 10*a* of member 10 and further deformation of beam 2 is prevented. It is preferred that straps 4 be attached to tie-down anchors 3 which are located on the ground opposite to the side from which strap 4 is attached to base supporting beam 2 (as in FIGS. 1 and 2), so that the angle formed by strap 4 with the ground is minimized so as to reduce the effect of slack in tie-down strap 4 on the firmness of the anchor formed thereby.

As should be readily apparent, there are a multiplicity of available methods for securing tie-down strap 4 to reinforcing members 10 and beam 2. Further, there are a multiplicity of positions where tie-down anchor 3 could be located and still provide a means for securing mobile home 1 to the ground.

Also, it should be readily apparent, that flange-engaging surfaces 10*a* of reinforcing member 10 could be flattened or extended so as to provide more surface area for engaging flanges 2*a*. Further, any number of apertures 11 could be used as desired.

Preferably, each member 10 is sufficiently short, so as to enable slidable insertion of it between flanges 2*a* without force. Also, reinforcing member 10 is preferably sufficiently long so that only slight deformation of flanges 3*a* is required before flanges 3*a* become in supporting contact with reinforcing member 10.

It will be understood that the various changes in the details, materials, steps, and arrangemets of parts which have been herein described and illustrated in order to explain the nature of the invention, may be made by those skilled in the art within the principle and the scope of the invention as expressed in the appended claims.

The embodiments of the invention in which an exclusive property is claimed are described as follows:

1. In combination with a mobile home or the like including a frame member having a central support member and a pair of spaced flanges extending outwardly to at least one side of said central support member and forming a channel portion with the inside surfaces of said flanges generally facing one another, reinforcing means for reinforcing said spaced flanges of said frame member so that the same can be secured to an anchor without collapsing said flanges toward one another, said reinforcing means comprising:

at least one rigid member having end edges and a length approximating the distance between said flanges, said member being positioned between said flanges and across said channel portion with said end edges of said member abutting said inside surfaces of said flanges;

at least two openings spaced along the length of said rigid member; and an elongated, flexible securing member for tying down said mobile home or the like; said openings receiving said securing member encircling the exterior of said frame and of said member, passed into and out of said openings such that said strap is on the exterior of said member between each of said openings and the adjacent end edge of said member and behind said member for at least a portion of the distance between said openings.

2. The reinforcing means of claim 1 wherein said openings are positioned so that one opening is adjacent each of said end edges with the greater part of said securing member extending between the flanges internally of the closure formed by the flanges, the frame member and the rigid member so that when the strap is placed under tension, the rigid member is secured in close abutting position with the ends of the flanges.

3. The reinforcing means of claim 2 wherein said rigid member is planar and generally rectangular shaped.

4. The combination of claim 1 wherein said frame member is a beam with said spaced flanges extending outwardly and perpendicularly of said central support member of said beam; said rigid member being generally flat and extending rectilinearly between and at right angles to said spaced flanges.

5. The combination of claim 4 wherein said beam is an I-beam with spaced flanges extending to either side of said central support member of said I-beam; said combination including a pair of said rigid members, one of said rigid members being included between said flanges on either side of the beam.

6. Reinforcing apparatus for the reinforcement of frames for mobile homes or the like comprising a mobile home, trailer, or the like having at least one frame member for support thereof, said frame member including a central support member and a pair of spaced flanges extending to at least one side of said central member and forming a channel therebetween; a rigid, reinforcing member extending between said flanges and across said channel with its ends abutting the inside surfaces of said flanges, said reinforcing member being spaced from said central support member adjacent the outer ends of said spaced flanges for supporting said flanges and preventing them from collapsing toward one another when said frame member is secured to a ground anchor.

7. The reinforcing apparatus of claim 6 wherein said reinforcing member is generally flat and rectangular and includes a pair of space openings therein, one opening adjacent either end of said reinforcing member, said openings receiving a flexible securing member woven therethrough and around said frame member for securing said mobile home to a ground anchor.

* * * * *